United States Patent [19]

Garmon

[11] 4,196,843

[45] Apr. 8, 1980

[54] TWO-PIECE CONTAINER WITH SELF-LOCKING COVER

[75] Inventor: Ivan E. Garmon, St. Joseph, Mo.

[73] Assignee: Champion International Corporation, Stamford, Conn.

[21] Appl. No.: 969,019

[22] Filed: Dec. 13, 1978

[51] Int. Cl.[2] ..... B65D 5/68; B65D 5/22

[52] U.S. Cl. ..... 229/45 R; 229/34 R

[58] Field of Search ..... 229/45, 34, 35

[56] References Cited

U.S. PATENT DOCUMENTS

| | | | |
|---|---|---|---|
| 2,370,927 | 3/1945 | Anderson | 229/45 |
| 2,456,841 | 12/1948 | Rushing | 229/45 |
| 2,551,814 | 5/1951 | Rushing et al. | 229/45 |
| 2,572,239 | 10/1951 | Bergstein | 229/34 R |
| 2,809,775 | 10/1957 | White | 229/34 R |
| 3,116,007 | 12/1963 | D'Esposito et al. | 229/45 |
| 3,202,337 | 8/1965 | Cramer et al. | 229/45 X |
| 3,687,354 | 8/1972 | Jennings | 229/34 R |

*Primary Examiner*—Davis T. Moorhead

*Attorney, Agent, or Firm*—Evelyn M. Sommer

[57] ABSTRACT

A self-locking, tamper-proof container is made of a paperboard material, and includes a tubular body portion, and a cooperating cover portion. The tubular body portion has a generally rectangular planar base portion, and a side wall formed of two opposed pairs of upstanding panel members. Two locking flaps are respectively hingedly connected to one pair of opposed upstanding panel members, with each locking flap being disposed on the outside surface of the associated panel member and extending downwardly. The cover member is of slightly large plan area than the base portion of the tubular body, and two opposed upstanding panels thereof are formed by side panels and folded-under elongated tab portions. Each tab portion has a U-shaped cut-out such that in the erected condition of the cover member, two locking pockets are disposed on the inside surface of the two opposed upstanding panels. The locking pockets cooperate with the locking flaps of the body portion when the cover member is telescopingly received by the body portion to thereby inhibit removal of the cover member from the body portion. The tubular body portion and the cover member are each formed from a blank of paperboard material.

9 Claims, 5 Drawing Figures

TWO-PIECE CONTAINER WITH SELF-LOCKING COVER

BACKGROUND OF THE INVENTION

The subject invention relates to a new and improved paperboard container of the type that includes a tubular body portion and a corresponding cover member. The tubular body portion and the cover member are preferably made from a single blank of paperboard material which can be readily manufactured by conventional rotary slotter and die-cutting equipment. The new and improved paperboard container of the subject invention includes a unitary self-locking means which are not readily visible to an observer, and which are operative to interlock the cover member with the tubular body portion to prevent the cover from being readily removed, thereby achieving a tamper-proof container.

The types of containers to which the subject invention relate are typically used for the bulk packaging of dry goods such as clothing, paper goods, novelties, etc. Such containers conventionally incorporate telescoping top and bottom members which are readily separated. Thus, during shipping and transporting of such containers, the cover member may be readily removed, thereby facilitating unauthorized entry into the container, and pilferage of the products. As is readily apparent, the container may be permanently sealed to prevent pilferage, however, the additional step of providing sealing in the form of straps or bands requires an additional step, and is costly, and in addition requires a substantial amount of time and expense in removal of the bands at the point of destination.

Accordingly, it is an object of the subject invention to provide a paperboard container for containing dry goods and the like which includes an integral tamper-proof, self-locking feature which is not readily visible to the observer, and which does not require additional structures in the form of straps, bands, or the like.

It is a further object to provide a self-locking paperboard container which is simple and relatively inexpensive to manufacture, and which, if tampered with, will result in visible physical damage to the container, thereby enabling the receiver of the container to readily determine whether or not the container has been tampered with during shipment.

It is a further object of the subject invention to provide a self-locking tamper-proof container having unitary locking means in the form of cooperating flaps and cooperating locking pockets disposed respectively in the base portion and cover member of the container, which locking features are self-locking, which may be readily disengaged to enable the container to be opened and reused for subsequent shipments.

SUMMARY OF THE INVENTION

In accordance with the subject invention, a self-locking paperboard container comprises a tubular body portion having a side wall which includes a plurality of upstanding, substantially rectangular panel members and a planar, generally rectangular base portion. The latter is provided with at least two locking flaps that are respectively hingedly connected to a pair of opposed upstanding panel members. Each locking flap is disposed on the outer surface of the associated panel member and extends downwardly toward the base portion of the tubular body portion. A cover member which is telescopingly received over the tubular body portion is of generally rectangular configuration and likewise includes a side wall having a plurality of upstanding panel members. Two opposed upstanding panel members are each defined by a side wall hingedly connected to an elongated tab portion, with the tab portion being disposed internally of the associated panel member. Each tab portion includes a U-shaped cut-out of a configuration corresponding to the configuration of the locking flap associated with the tubular body portion. Each elongated tab portion, and its associated panel member, define a locking pocket. The locking pockets provided on the inside surface of the two opposed upstanding panels of the cover member are adapted to cooperate with the locking flaps of the body portion when the cover member is telescopingly received onto the tubular body portion. At such time, the locking flaps and the locking pockets interengage and cooperate to inhibit removal of the cover member from the body portion. Should the unauthorized removal of the cover member from the body portion be attempted, the locking flaps may be permanently damaged, thereby providing visible evidence of the unauthorized tampering of the container during shipment.

Both the tubular body portion and the cover member are each preferably formed from a single paperboard blank. The blank for forming the body portion includes a central, generally rectangular planar base portion, as well as opposed pairs of side walls hingedly connected to the base portion. An elongated tab is connected to each of two opposed side walls. A locking flap is cut out of the elongated tab as well as the associated side wall, and is hingedly connected to the side wall along a hinge line extending parallel to the hinge line connection between the side wall and the central base portion. Each side wall to which the locking flap is hingedly connected includes end wall tabs hingedly connected to the other two edges thereof, with a fold line being provided in each wall tab and aligned with the hinged connection between the side wall and the elongated tab. In the erected condition of the body portion of the container, the end wall tabs and the elongated tabs are folded in such manner as to provide reinforced corners for the body portion.

The blank for forming the cover member includes a central, rectangular-shaped cover portion, and first and second pairs of hingedly connected side walls. The first pair of side walls includes hingedly connected end tabs, while the second pair of side walls includes elongated tabs hingedly connected along hinge lines parallel to the hinge connections between said side walls and the central rectangular cover portion. U-shaped cut-outs are provided in the elongated tabs, and such tabs cooperate with the end walls to form the locking pockets in the cover member.

DETAILED DESCRIPTION OF THE PREFERRED EMBODIMENT

Figure 1:
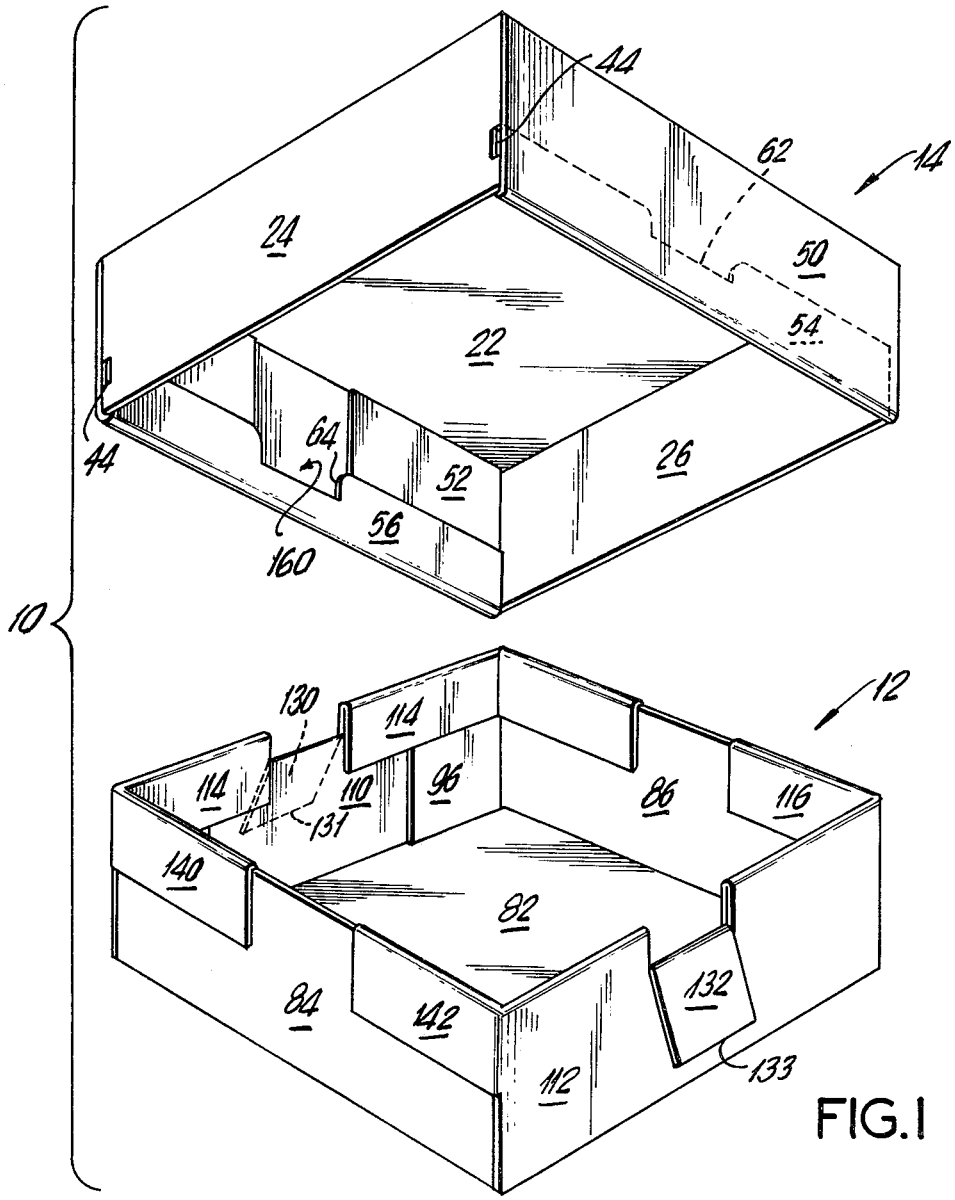
FIG. 1 is a perspective view of the cover member and body portion forming the self-locking, tamper-proof container according to the subject invention.
Figure 4:
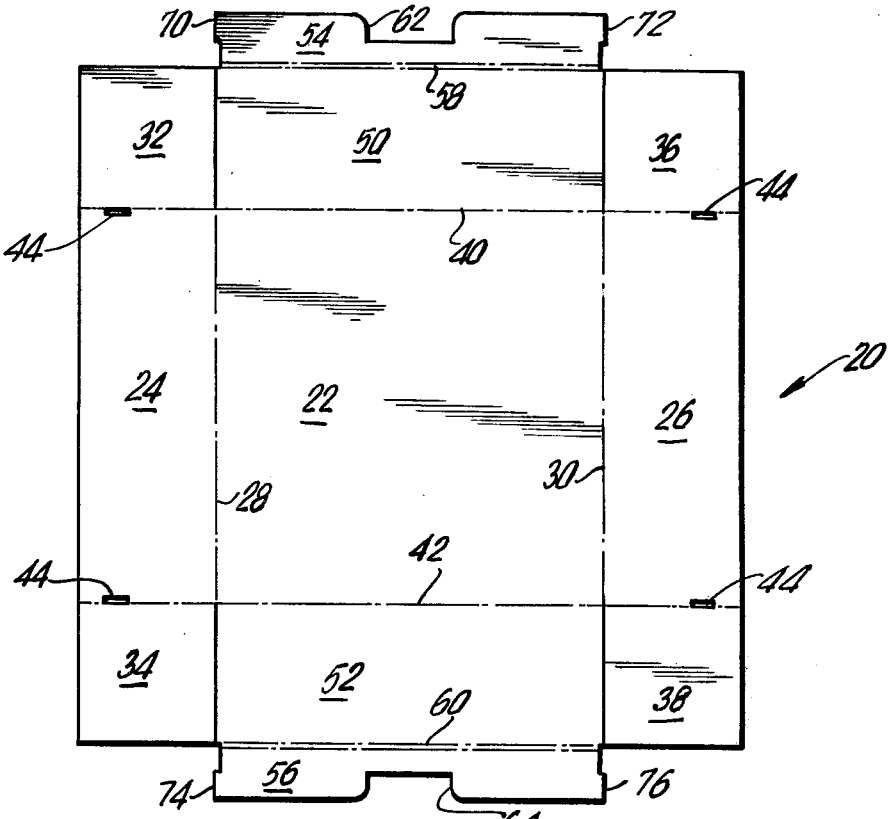
FIG. 4 is a plan view of the blank forming the cover member of the subject invention.

Referring to FIG. 1, the self-locking, tamper-proof container of the subject invention is generally designated by the numeral 10 and basically comprises a tubular body portion 12, and a cover member 14 which is telescopingly received over the body portion 12. Both the tubular body portion 12 and the cover member 14 are preferably formed of a single blank of paperboard material which is die-cut and scored in order to form a unitary construction. The blank for forming the cover member 14 is illustrated in FIG. 4 and is generally designated by the numeral 20. Blank 20 includes a central, generally rectangular, planar cover portion 22 to which is hingedly connected a first pair of side wall panels, 24, 26 along hinge lines 28, 30. Side wall panel 24 has opposed end tabs 32 and 34 which are hingedly connected along hinge lines 40 and 42. Likewise, side wall panel 26 includes end tabs 36 and 38 connected along hinge lines 40 and 42. Locking apertures 44 are provided in the hinge connections 40 and 42 between each side wall panel 24, 26 and its associated end tabs 32–38. Connected to the remaining two opposed edges of the central cover portion 22 along hinge lines 40 and 42 are side wall panels 50 and 52. In turn, elongated tabs 54 and 56 are hingedly connected to the side wall panels 50 and 52 along hinge lines 58 and 60, with each tab including a U-shaped cut-out 62, 64. In addition, each tab includes locking flanges 70–72 and 74–76 disposed on opposite ends thereof, and adapted to engage the locking apertures 44 in the erected condition of the cover member 14, as shown in FIG. 1.

Figure 5:
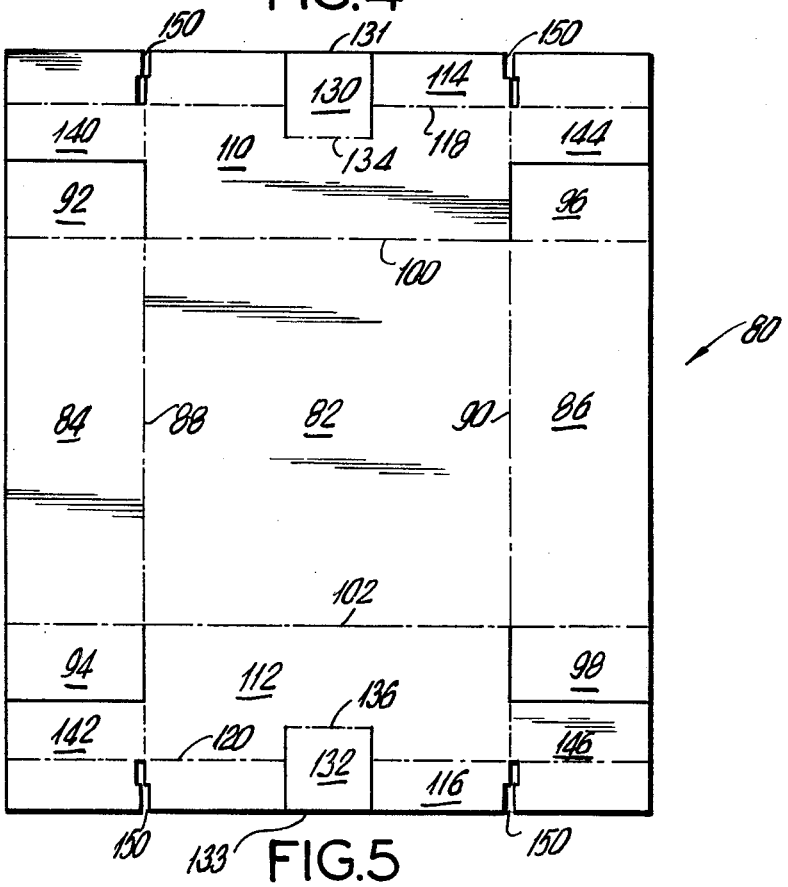
FIG. 5 is a plan view of the blank for forming the tubular body portion of the subject invention.

The blank 80 for forming the tubular body portion 12 is illustrated in FIG. 5 and includes a generally rectangular, planar central portion 82 which is of smaller area than the central portion 22 of cover member 14. Hingedly connected to the central portion 82 are opposed side walls 84 and 86 connected along hinge lines 88 and 90. Each side wall portion, 84, 86 includes tabs 92–94 and 96–98 connected along hinge lines 100 and 102. The remaining two opposed edges of the central portion 82 are hingedly connected along hinge lines 100 and 102 to side walls 110 and 112. Elongated tabs 114 and 116 are respectively connected to the side walls 110 and 112 along hinge lines 118 and 120. A locking flap 130, 132 is provided in each side wall 110, 112 and extends through the elongated tabs 114, 116, and partially into the side walls 110, 112, for pivotal connection thereto along hinge lines 134, 136. Hingedly connected to the opposite side edges of the side walls 110 and 112 are end wall reinforcing tabs 140–144 and 142–146 connected along hinge lines 88 and 90. Offset cut-outs 150 of S-shaped configuration separate the elongated tabs 114, 116 from the associated end wall reinforcing tabs 140–146.

Figure 2:
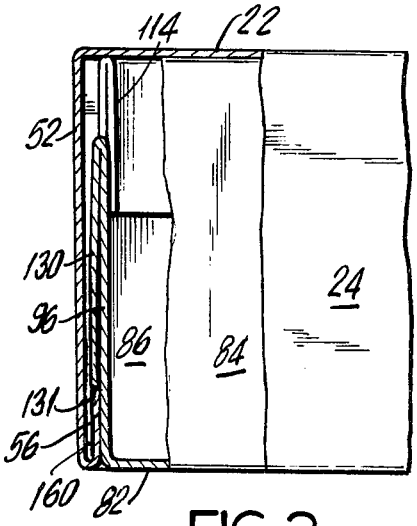
FIG. 2 is a partial cross-sectional view of the locking engagement of the cover member and the body portion in the closed condition of the container of the subject invention.
Figure 3:
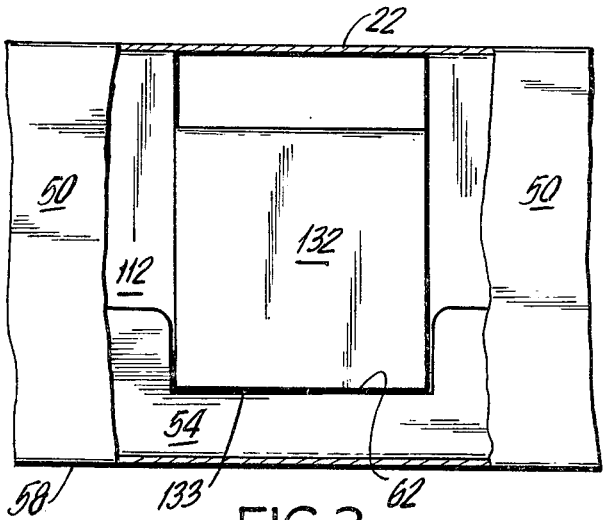
FIG. 3 is a partial sectional elevational view of the locking engagement of the cover member and the body portion of the subject invention.

Referring to FIG. 1, in the erection of the cover member 14, the end tabs 32–38 are folded about the hinge lines 40 and 42, after which side walls 24 and 26 are folded about the hinge lines 28 and 30. The side walls 50 and 52 are then folded about the hinge lines 40 and 42 so as to enclose the end tabs 32–38 after which the elongated tabs 54 and 56 are folded about the hinge lines 58 and 60 inwardly of the cover member 14, until such time as the locking flanges 70–76 engage and lock into the locking apertures 44. It is noted that both of the hinge lines 58 and 60 comprise two parallel spaced hinge lines in order to accommodate the thickness of the end tabs 32–38. As shown in FIGS. 1 through 3, in the erected condition of the cover member 14, the elongated tabs 54 and 56 cooperate with the side wall panels 50 and 52, as well as with the end tabs 32–38 in defining locking pockets, designated by the numeral 160 for receiving the cooperating locking flaps 130, 132 of the tubular body portion, as more fully described hereinafter.

In the assembly of the blank 80 forming the tubular body portion 12, tabs 92–98 are folded about hinge lines 100 and 102, after which the side walls 84 and 86 are folded about hinge lines 88 and 90. Side walls 110 and 112 are then folded about hinge lines 100 and 102, after which the end wall reinforcing tabs 140–146 are folded about the hinge lines 88 and 90. The portions of the end wall reinforcing tabs 140–146 disposed outwardly of the hinge lines 118 and 120 are then folded about the hinge lines 118 and 120 so as to abut the inside surfaces of the side walls 84 and 86, whereby each end wall reinforcing tab 140–146 is folded over and engages the opposite sides of the associated side walls 84 and 86, thereby providing a reinforcing top edge for said side walls. The elongated tabs 114 and 116 are then inwardly folded about the hinge lines 118 and 120 so as to overlie the tabs 92–96, and such that the offset cut-outs 150 interlock to maintain the tubular body portion 12 in its erected condition, as shown in FIG. 1. The locking flaps 130 and 132 are then folded outwardly about their associated hinge lines 134 and 136 such that each locking flap extends downwardly toward the base portion 82, but is disposed externally of the erected tubular body portion 12. As shown in FIG. 1, the folded-over end wall reinforcing tabs 140–146 as well as the folded-over elongated tabs 114, 116 provide a reinforced upper side wall portion to the corners of the tubular body portion 12. This reinforced corner structure provides additional rigidity to the container 10 as well as smooth upper edges to the tubular body portion 12.

In the assembled condition of the container 10, the cover member 14 is placed over the tubular body portion 12 and telescopingly forced downwardly such that the cantilevered locking flaps 130, 132 are initially forced against the elongated tabs 54, 56, until such time that the U-shaped cut-outs 62, 64 pass the outward ends 131, 133 of the locking flaps 130, 132. The natural bias of the locking flaps 130, 132 outwardly then causes the locking flaps to extend into and cooperate with the U-shaped cut-outs 62, 64, so as to be in the region of the locking pockets 160. At such time, it is noted that the interlocking relationship of the tubular body portion 12 and the cover member 14 is wholly disposed within the container, and is not visible to an observer. Accordingly, in an attempt to tamper with the container 10 in order to gain access therewithin, a person not familiar with the construction of the locking arrangement of the container would merely assume that is is necessary to lift the cover member 14 relative to the body portion. However, if such an attempt is made, the interlocking relationship of the locking flaps 130, 132 and the locking pockets 160 preclude telescoping of the cover member 14 relative to the body portion 12. If continued force is applied by the person seeking unauthorized access to the container, the locking flaps 130, 132 would be subjected to an axial force which, upon increase, may result in the locking flap slipping into the pockets defined between the elongated tabs 54, 56 and the associated side walls 50, 52, thereby providing an even greater resistance to opening of the container. Continued application of force to the cover member 14 would result in destruction of the several components of the container, including the locking flaps 130, 132, and such permanent damage to the carton will be readily visible to the shipper of the container.

The shipper can readily remove the cover member 14 from the tubular body portion 12 by separating the side walls of the cover member 14 and the tubular body portion 12, prior to the application of a lifting force onto the cover member. After the side walls are separated, it is merely necessary to depress the locking flaps 130, 132 against the associated side walls 110, 112, and gently lift the cover member relative to the tubular body portion.

Accordingly, there is provided a new and improved self-locking, tamper-proof container including a cover member and a tubular body portion, both of which are formed from a single blank preferably made of a paperboard material. The cover member includes interengaging locking flanges and locking apertures, and may be readily manufactured and assembled. The tubular body portion 12 includes overlapping tab portions which provide reinforcing corners for the body portion, thereby adding to the rigidity and strength of the resulting container. The locking flaps cooperate with locking pockets disposed in the cover member so as to provide an interlocking relationship which is not visible to a person not familiar with the construction of a container.

While the preferred embodiment of the subject invention has been described and illustrated, it would be obvious that various changes and modifications can be made therein without departing from the spirit of the invention which should be limited only by the scope of the appended claims.

What is claimed is:

1. A self-locking tamper-proof container comprising:

a tubular body portion having first and second opposed pairs of side walls and a planar base portion; each side wall of said first pair including a pair of hingedly connected corner tabs; each side wall of said second pair including along one edge thereof an elongated tab, with each side wall of said second pair further including a locking tab hingedly connected thereto, and with each side wall of said second pair further including a pair of end wall reinforcing tabs hingedly connected to each opposed side edge thereof; with said corner tabs, elongated tabs and reinforcing tabs cooperating to form a reinforced folded-over, multi-wall construction at each upper corner portion of said body portion; and with each of said locking flaps being disposed on the outer surface of the associated side wall of said second pair and extending downwardly toward the base portion; and a cover member of a configuration corresponding to the configuration of the tubular body portion, said cover member having a side wall including a plurality of upstanding panel members and a planar cover portion of slightly larger plan area than said base portion, said cover member further including at least two locking pockets disposed on the inside surface of two opposed upstanding panels, said locking pockets being of a configuration to cooperate with the locking flaps of the body portion when the cover member is placed on said body portion to thereby inhibit removal of the cover member from the body portion.

2. A self-locking, tamper-proof container as in claim 1 wherein said tubular body portion and said cover member are made of paperboard material.

3. A self-locking, tamper-proof container as in claim 1 wherein the planar base portion of the tubular body member and the planar cover portion of the cover member are generally rectangular in plan form.

4. A self-locking, tamper-proof container as in claim 1 wherein each locking flap is generally rectangular in configuration, and wherein each locking pocket comprises a tab hingedly connected to the bottom edge of the associated upstanding panel, said tab being disposed internally of said cover member and including a U-shaped cut-out portion for receiving the respective locking flap.

5. A self-locking, tamper-proof container as in claim 1 wherein each locking flap is formed integral with the tubular body portion.

6. A self-locking, tamper-proof container as in claim 1 wherein each locking pocket is integral with the cover member.

7. A self-locking, tamper-proof container as in claim 1 wherein each locking flap is disposed substantially equidistant along the longitudinal length of the associated side wall, and wherein each U-shaped cut-out in the side wall of the cover member is also disposed substantially equidistant along the longitudinal length of the associated side wall.

8. A pair of blanks for forming a self-locking paperboard container having a tubular body portion and a cooperating cover member comprising:

a first blank for forming said body portion, said first blank including a central, generally rectangular planar base portion, a first pair of side walls hingedly connected to opposed edges of the base portion, each said side wall having corner tabs hingedly connected to the opposed free ends thereof; a second pair of side walls hingedly connected to the other two opposed edges of the base portion, each said second side wall having: (1) an elongated tab hingedly connected thereto along a score line extending parallel to the hinged connection between said side wall and the base portion; and (2) an end wall reinforcing tab hingedly connected to the other two opposed edges thereof, each said elongated tab being spaced from the associated reinforcing tab by an offset cut-out; each said second side wall further including a locking flap cut-out of the elongated tab and said side wall, and hingedly connected along a hinge line disposed in said side wall and extending parallel to the hinge line connecting said side wall to the central base portion; and a second blank for forming said cover member including a central, generally rectangular cover portion, said cover portion being of a larger area than the base portion of said body portion; first and second pairs of side walls respectively hingedly connected to the opposed edges of said rectangular central portion, each side wall of said first pair of side walls having end tabs hingedly connected to the opposed free ends thereof, while each said side wall of said second pair of side walls includes an elongated tab hingedly connected to the elongated edge of said side wall opposite its hinge connection to the central cover portion, each said tab having a U-shaped cut-out which, in the erected condition of said second blank, forms with the associated side wall a locking pocket for engaging and receiving a locking flap of the first blank so as to inhibit removal of the erected cover member from the erected body portion.

9. A pair of blanks for forming a self-locking paperboard container having a tubular body portion and a cooperating cover member as in claim 11 wherein said second blank further includes locking apertures disposed in said first pair of side walls and aligned with the hinge connection between each side wall of said first pair of side walls and its associated end tab, and wherein said elongated tabs hingedly connected to said second pair of side walls include locking flanges at the opposite edges thereof, which locking flanges, in the erected condition of the second blank, engage said locking apertures for maintaining said second blank in its erected condition.

* * * * *